US007395816B2

(12) United States Patent
Loevenbruck

(10) Patent No.: US 7,395,816 B2
(45) Date of Patent: Jul. 8, 2008

(54) EVAPORATIVE EMISSIONS CONTROL DEVICE FOR A VEHICLE FUEL SYSTEM

(75) Inventor: Remi B Loevenbruck, Habay La Neuve (BE)

(73) Assignee: Delphi Technologies, Inc., Troy, MI (US)

( * ) Notice: Subject to any disclaimer, the term of this patent is extended or adjusted under 35 U.S.C. 154(b) by 253 days.

(21) Appl. No.: 11/414,621

(22) Filed: Apr. 28, 2006

(65) Prior Publication Data

US 2006/0207577 A1 Sep. 21, 2006

(30) Foreign Application Priority Data

Feb. 6, 2005 (EP) ..... 05253389

(51) Int. Cl.
*F02M 33/02* (2006.01)

(52) U.S. Cl. ..... 123/519; 123/520

(58) Field of Classification Search ..... 123/520, 123/518, 519, 458, 516, 198 D
See application file for complete search history.

(56) References Cited

U.S. PATENT DOCUMENTS 5,245,973 A * 9/1993 Otsuka et al. ..... 123/518
5,359,978 A * 11/1994 Kidokoro et al. ..... 123/520
5,456,238 A * 10/1995 Horiuchi et al. ..... 123/520
5,806,500 A * 9/1998 Fargo et al. ..... 123/520
7,261,093 B2 * 8/2007 Groom et al. ..... 123/520
2003/0089345 A1 * 5/2003 Itou et al. ..... 123/520
2004/0173190 A1 * 9/2004 Makino ..... 123/520
2004/0173512 A1 * 9/2004 Frye ..... 210/130

* cited by examiner

*Primary Examiner*—Carl S. Miller
(74) *Attorney, Agent, or Firm*—Patrick M. Griffin

(57) ABSTRACT

The evaporative emissions control device comprises a housing having an inlet connectable to a vent port of an evaporative emissions control canister and an outlet for venting to the atmosphere, the housing containing a carbon filter, a bypass passage, and a valve for selectively closing the bypass passage and/or outlet. In a first operating state the valve closes the bypass passage and opens the outlet, whereby gases from the vent port of the canister pass through the adsorbent material before the air is released via the outlet port. In a second operating state the valve opens both the outlet and the bypass passage, whereby the gases can bypass the adsorbent material to provide a high flow rate, for example during refuelling. In a third operating state the valve closes both the outlet and bypass passage, preventing the release of any fuel vapour through the outlet and into the atmosphere.

10 Claims, 5 Drawing Sheets

EVAPORATIVE EMISSIONS CONTROL DEVICE FOR A VEHICLE FUEL SYSTEM

The present invention relates to an evaporative emissions control device for a vehicle fuel system capable of complying with the on-board diagnostics (OBD II) evaporative fuel vapour emissions regulation and in particular an evaporative emissions control device for controlling the venting of gases from a carbon canister of a vehicle evaporative emissions control system.

It is necessary to vent the air space in the upper regions of a vehicle fuel tanks (known as the headspace) in order to prevent air locks as a tank is emptied in use and particularly during refuelling when air is displaced from the headspace as the tank is filled with fuel and to compensate for pressure changes in the headspace due to evaporation of fuel and subsequent condensation during changes in ambient temperature.

However, modern vehicle emission standards place strict limits on the evaporative emission of fuel vapour from vehicle fuel tanks and fuel systems. To achieve these emission standards, most modern vehicles are equipped with onboard refuelling vapour recovery (ORVR) systems.

A typical ORVR system comprises a narrow filler neck to form a seal with a refuelling nozzle to prevent fuel vapour escaping via the filler neck and an adsorption canister containing an activated carbon filter material provided in a tank headspace vent passage, to trap fuel vapour while permitting the passage of air through a vent port to the atmosphere during refuelling of a vehicle. Periodically, during operation of the vehicle, adsorbed fuel vapour trapped in the canister is removed by drawing air through the canister through a purge line communicating with the air-intake system of the engine such that the desorbed fuel vapour is burnt in the engine.

Such ORVR systems have to satisfy the conflicting requirements of preventing the venting to the atmosphere of fuel vapour from the fuel tank while avoiding excessive flow restriction in the vent passage and resulting pressure build up within the tank during refilling.

According to the present invention there is provided an evaporative emissions control device for controlling the venting of gases from a carbon canister of a vehicle evaporative emissions control system, the control device comprising a housing having an inlet port connectable to the vent port of the carbon canister and an outlet port for venting the housing to the atmosphere, the housing defining a chamber containing an adsorbent material located in a flow path between the inlet port and outlet port and capable of adsorbing fuel vapour, wherein the device includes a bypass passage communicating with the inlet port and the outlet port, bypassing the adsorbent material, and valve means for controlling the flow of air through the bypass passage and for controlling the flow of gases through the outlet port.

In a preferred embodiment the device has three operating states. In a first operating state the valve means is operated to close the bypass passage and open the outlet port, whereby gases from the vent port of the carbon canister must pass through the adsorbent material, wherein fuel vapour is trapped, before the gases can be released to the atmosphere via the outlet port of the device. In a second operating state the valve means is operated to open both the outlet port and the bypass passage, whereby gases from the vent port of the carbon canister can freely pass between the inlet port and outlet port through the bypass passage, bypassing the adsorbent material, to provide a high flow rate and minimal pressure drop, for example during refuelling. In a third operating state the valve means is operated to close both the outlet port and the bypass passage, preventing the release of any fuel vapour through the outlet port and into the atmosphere, effectively closing off the vent port of the carbon canister. Such third operating state can be used during the OBD 2 test.

In a preferred embodiment the valve means of the device comprises a poppet valve having a valve head, arranged between a first end of the bypass passage and the outlet port, and an elongate valve stem, extending from the valve head into the bypass passage. The valve means is moveable between a first position wherein the valve head abuts a valve seat surrounding the outlet port to close the outlet port and a second position wherein the valve head is spaced from said valve seat to open the outlet port. The valve means has a further valve member provided on the valve stem, said further valve member being adapted to obscure and close the bypass passage when the valve means is in its first position and to be spaced from a second end of the bypass passage to open the bypass passage when the valve means is in its second position. The further valve member is arranged on the valve stem such that bypass passage remains obscured by said further valve member as the valve means moves from its first position towards its second position until the valve reaches an intermediate position between said first and second positions, at which intermediate position the bypass passage is opened.

Preferably the further valve member is dimensioned to be locatable within the bypass passage to block the bypass passage and to prevent the flow of gases therethrough when the further valve member is located therein. The position of the further valve member on the valve stem is preferably such that the further valve member is located within the bypass passage to close the bypass passage when the valve means is between its first and intermediate positions and is located outside of the bypass passage to open the bypass passage when the valve means is at or between its intermediate and second positions.

In a preferred embodiment an electrical actuator, such as a solenoid, is provided for moving the valve means between its first, intermediate and second positions.

Preferably the valve means is moveable by an actuating solenoid arranged coaxially with the bypass passage.

Preferably the control device comprises a cylindrical housing, the bypass passage comprising a cylindrical tube arranged concentrically within the cylindrical housing, the adsorbent material being provided in an annular space defined between the bypass tube and the housing.

Preferably the adsorbent material comprises activated carbon.

A pressure sensor may be mounted on the housing for determining the pressure within the chamber.

An embodiment of the invention will now be described by way of example only with reference to the accompanying drawings in which.

Figure 1:
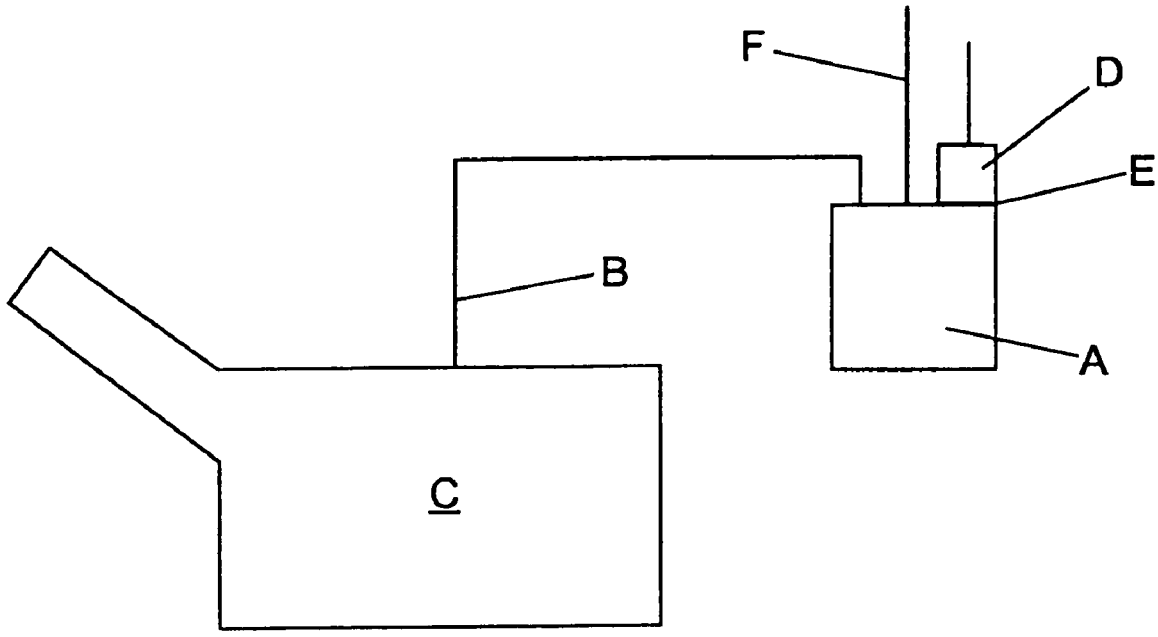
FIG. 1 is a schematic view of the fuel tank and evaporative emissions control system of an automotive vehicle, fitted with an evaporative emissions control device according to a preferred embodiment of the present invention.
Figure 2:
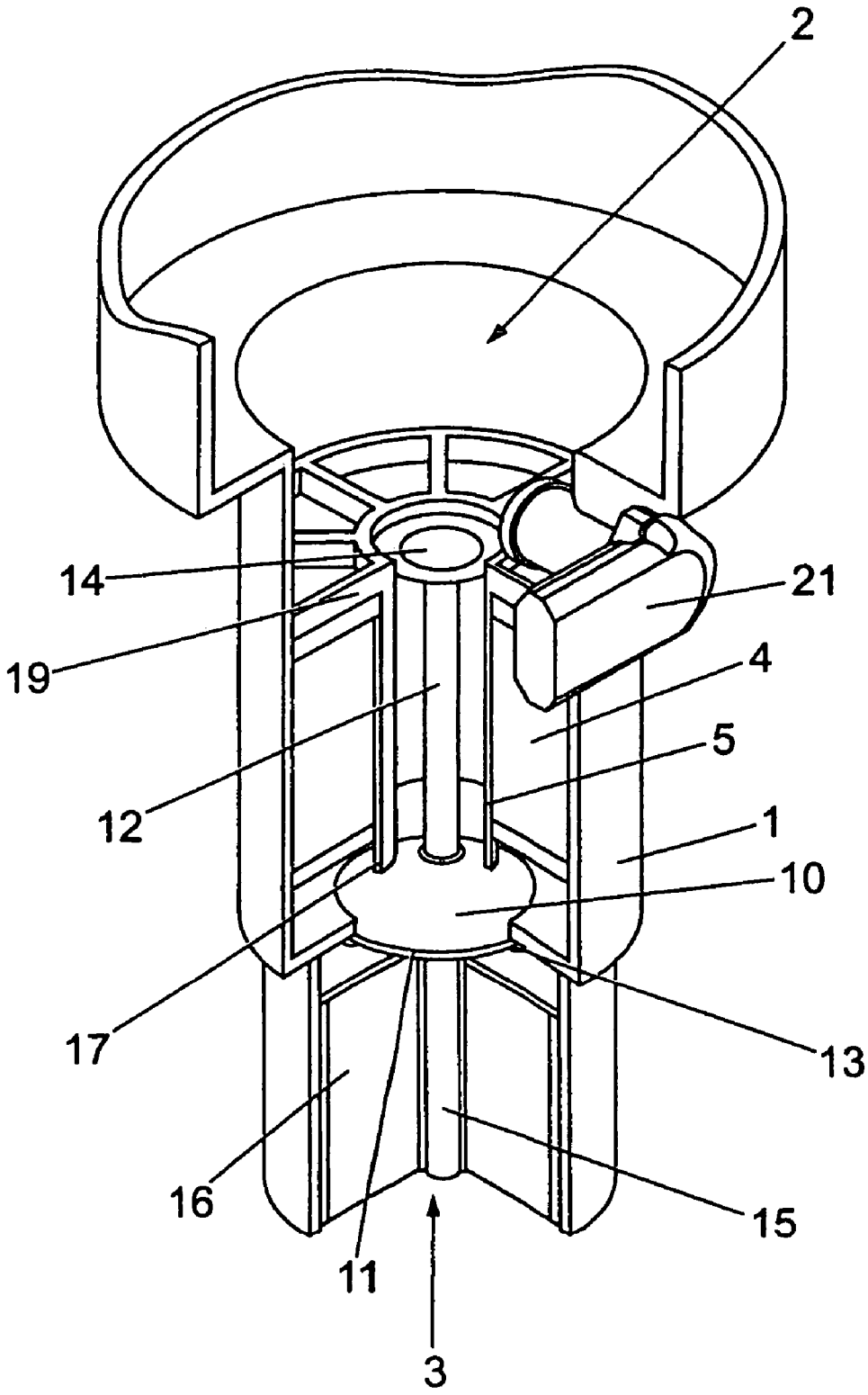
FIG. 2 is a part sectional perspective view of the evaporative emissions control device of FIG. 1.

As shown in FIG. 1, the evaporative emissions control system includes a carbon canister A connected to the vent port B of the vehicle fuel tank C, the carbon canister A having an inlet port communicating with the headspace of the fuel tank C, a vent port E for venting the canister, and thus the headspace of the fuel tank C, to the atmosphere and a purge port F communicating with the air intake system of the engine to purge the canister of fuel vapour during operation of the engine. The carbon canister A contains activated carbon for adsorbing fuel vapour from gases passing into the carbon canister from the headspace of the fuel tank C. An evaporative emissions control device D according to the present invention is mounted on or adjacent the carbon canister A.

As shown in FIGS. 2 to 5, the evaporative emissions control device D comprises a cylindrical housing 1 having an inlet port 2 communicating with the vent port of the carbon canister A and an outlet port 3 communicating with the ambient atmosphere.

A body of adsorbent material 4 comprising activated carbon is provided within a chamber defined by the housing 1 in a flow path between the inlet port 2 and outlet port 3.

A tubular bypass passage 5 is mounted concentrically within the housing 1 to provide a flow path between the inlet port 2 and the outlet port 3, bypassing the adsorbent material 4, the adsorbent material 4 being provided in the annular space defined between the inner surface of the housing and the outer surface of the bypass tubular member defining the bypass passage 5.

A poppet valve 10 is mounted within the housing 1 having a valve head 11 and an elongate valve stem 12 extending from the valve head 11 into and through the bypass passage 5, coaxial with the housing 1 and the bypass passage 5. The valve head 11 cooperates with a valve seat 13 surrounding the outlet port 3 such that the valve 10 can close the outlet port 3 when the valve head 11 abuts the valve seat 13.

A disc shaped valve member 14 is provided at a distal end of the valve stem 12, the outer diameter of the valve member 14 being substantially equal to the inner diameter of the bypass passage 5 such that the valve member 14 can block the bypass passage 5, preventing the flow of air therethrough, when the valve member 14 is located within the bypass passage 5.

A further valve stem 15 extends from the valve head 11 through the outlet port 3 into a coil of an actuating solenoid 16, the further valve stem 15 defining the armature of the solenoid 16 whereby the valve 10 can be axially displaced within the housing 1 between a first position, wherein the valve head 11 abuts the valve seat 13 and the valve member 14 is located within the bypass passage 5 to close said passage 5, and a second position wherein the valve head 11 is spaced from the valve seat 13 and the valve member 14 is located outside of the bypass passage 5.

A first end 17 of the bypass passage 5, closest to the valve seat 13, preferably has at least one axially extending cut out portion 18 therein such that the valve head 11 may abut said first end 17 of the bypass passage 5 when in its second position, the at least one axially extending cut out portion 18 providing a passageway between the first end 17 of bypass passage 5 and the outlet port 3. In the preferred embodiment shown in the drawings, the first end 17 of the bypass passage 5 has a castellated formation to provide a plurality of such passageways 18.

The relative lengths of the valve stem 12 and the bypass passage 5 are such that, when the valve 10 is positioned in an intermediate position between its first and second positions, the valve head 11 is spaced from the valve seat 13 but the valve member 14 remains within a second end region 19 of the bypass passage 5, opposite said first end 17, to close the bypass passage 5.

A spring 20 (see FIGS. 3-5) is mounted within the housing 1, biasing the valve head 11 away from the valve seat 13.

The device has three operating states.

Figure 3:
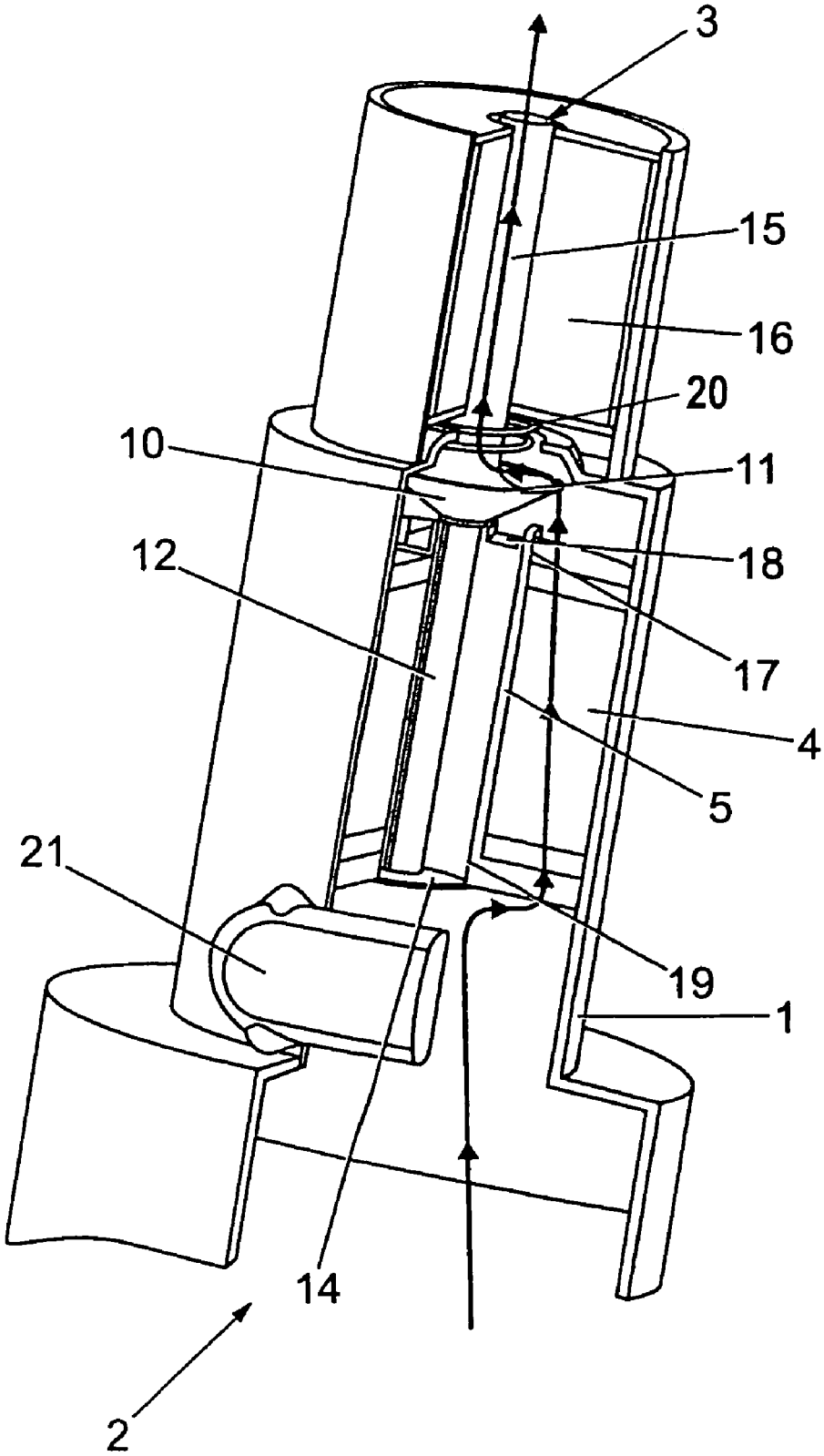
FIG. 3 is a part sectional perspective view of the device of FIG. 1 in a first operating state for use during normal engine operating conditions and when the vehicle is at rest.

In a first operating state, shown in FIG. 3, for use during normal operation of the vehicle and when the vehicle is at rest, the poppet valve 10 is moved to its above described intermediate position whereby the valve head 11 is spaced from the valve seat 13 such that gases can pass out of the outlet port 3 to the ambient atmosphere and the valve member 14 is located within the second end region 19 of the bypass passage 5, closing the bypass passage 5, whereby gases from the vent port of the carbon canister A entering the housing 1 through the inlet port 2 must pass through the adsorbent material 4, wherein any remaining fuel vapour is trapped, before the air can be vented to the atmosphere via the outlet port 3.

Figure 4:
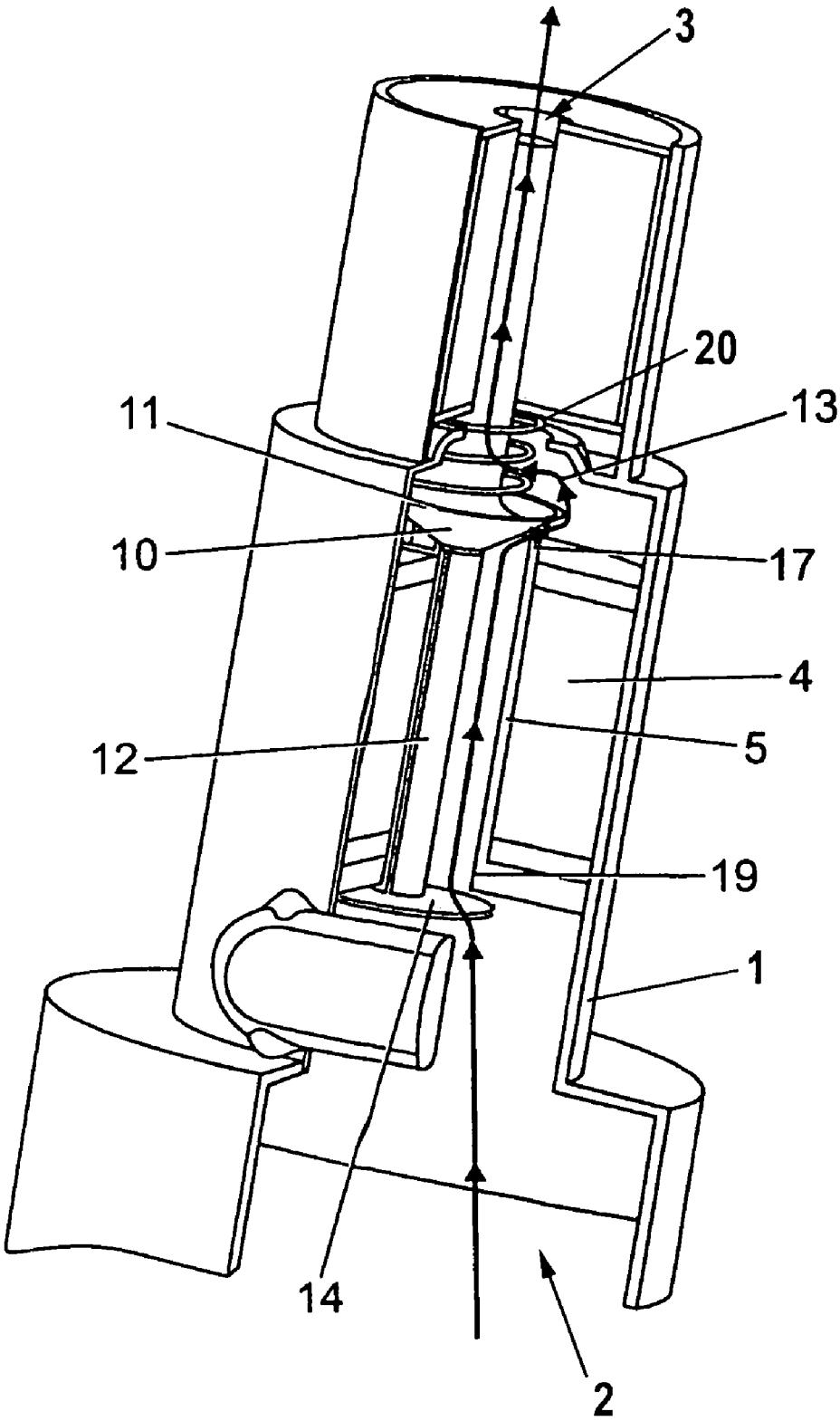
FIG. 4 is a part sectional perspective view of the device of FIG. 1 in a second operating state for use when refuelling and when a high flow rate of through the vent pipe is required.

In a second operating state, shown in FIG. 4, for use during refilling or when a high flow rate of vented air is required, the poppet valve 10 is moved to its above described second position wherein the valve head 11 abuts the castellated first end 17 of the bypass passage 5 to fully open the outlet port 3 and the valve member 14 is moved out of the second end of the bypass passage 5 to open both the outlet port 3 and the bypass passage 5, whereby gases can freely pass between the inlet port 2 and outlet port 3 through the bypass passage 5, bypassing the adsorbent material 4, to provide a high flow rate and minimal pressure drop, for example during refuelling.

Figure 5:
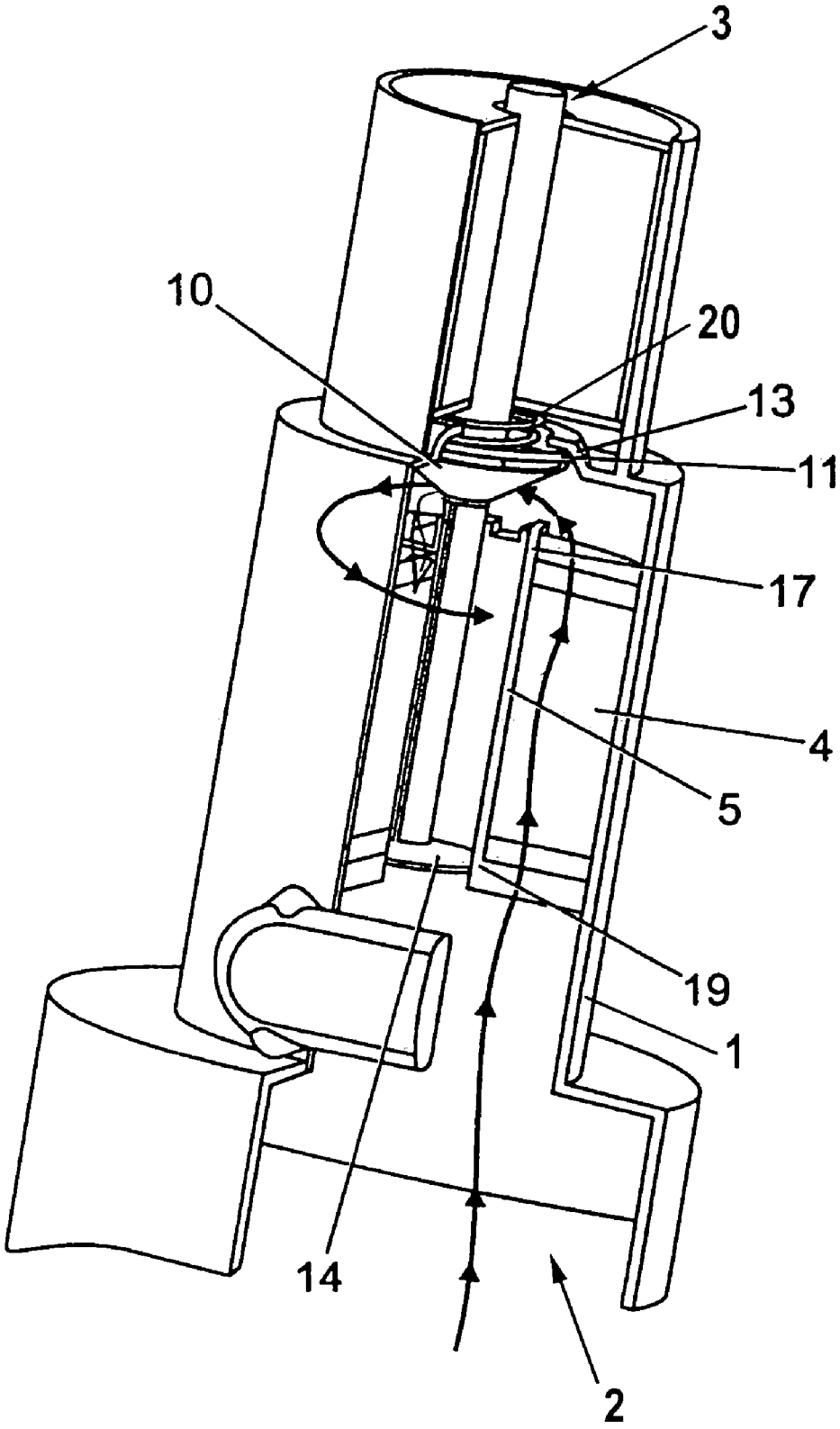
FIG. 5 is a part sectional perspective view of the device of FIG. 1 in a third operating state for use during the OBD II evaporative emissions test.

In a third operating state, shown in FIG. 5 the poppet valve 10 is moved to its above described first position wherein the valve head 11 abuts the valve seat 13 to close the outlet port 3 and the valve member 14 is positioned within the second end region 19 of the bypass passage 5 to close the bypass passage 5, preventing the release of any fuel vapour containing air through the outlet port 3 and into the atmosphere, air entering the housing 1 passing into the adsorbent material 4 such that any fuel vapour therein is retained within the adsorbent material 4. Such third operating state can be used during the OBD 2 test.

A pressure sensor 21 is mounted on the housing 1 to determine the pressure within the housing 1 and can be used to control operation of poppet valve 10 to place the device in its second operating state when a high pressure drop between the interior of the housing 1 and the ambient atmosphere is detected.

It is envisaged that the operation of the device would be under the control of the engine management system such that the device could be placed into its third operating state, preventing the release of any fuel vapour, during the bi-annual OBD II test.

The invention claimed is:

1. An evaporative emissions control device for controlling the venting of gases from a carbon canister of a vehicle evaporative emissions control system, the control device comprising a housing having an inlet port connectable to the vent port of the carbon canister and an outlet port for venting the housing to the atmosphere, the housing defining a chamber containing an adsorbent material located in a flow path between the inlet port and outlet port and capable of adsorbing fuel vapour, wherein the device includes a bypass passage communicating with the inlet port and the outlet port, bypassing the adsorbent material, and valve means for controlling the flow of air through the bypass passage and for controlling the flow of gases through the outlet port.

2. A device as claimed in claim 1, having first, second and third operating states, in the first operating state the valve means being operated to close the bypass passage and open the outlet port; in the second operating state the valve means being operated to open both the outlet port and the bypass passage, whereby gases can freely pass between the inlet port and outlet port through the bypass passage; and in the third operating state the valve means being operated to close both the outlet port and the bypass passage, preventing the release of any fuel vapour through the outlet port and into the atmosphere.

3. A device as claimed in claim 1, wherein the valve means of the device comprises a poppet valve having a valve head, arranged between a first end of the bypass passage and the outlet port, and an elongate valve stem, extending from the valve head into the bypass passage, the valve means being moveable between a first position wherein the valve head abuts a valve seat surrounding the outlet port to close the outlet port and a second position wherein the valve head is spaced from said valve seat to open the outlet port, the valve means having a further valve member provided on the valve stem, said further valve member being adapted to obscure and close the bypass passage when the valve means is in its first position and to be spaced from a second end of the bypass passage to open the bypass passage when the valve means is in its second position, the further valve member being arranged on the valve stem such that bypass passage remains obscured by said further valve member as the valve means moves from its first position towards its second position until the valve reaches an intermediate position between said first and second positions, at which intermediate position the bypass passage is opened.

4. A device as claimed in claim 3, wherein a first end of the bypass passage, closest to the valve seat, preferably has at least one axially extending cut out portion therein such that the valve head may abut said first end of the bypass passage when in its second position, the at least one axially extending cut out portion providing a passageway between the first end of bypass passage and the outlet port.

5. A device as claimed in claim 3, wherein the further valve member is dimensioned to be locatable within the bypass passage to block the bypass passage and to prevent the flow of air therethrough when the further valve member is located therein.

6. A device as claimed in claim 5, wherein the position of the further valve member on the valve stem is such that the further valve member is located within the bypass passage to close the bypass passage when the valve means is between its first and intermediate positions and is located outside of the bypass passage to open the bypass passage when the valve means is at or between its intermediate and second positions.

7. A device as claimed in claim 1, wherein an electrical actuator, is provided for operating the valve means.

8. A device as claimed in claim 7, wherein the valve means is moveable by an actuating solenoid arranged coaxially with the bypass passage.

9. A device as claimed in claim 1, wherein the housing of the device is cylindrical, the bypass passage comprising a cylindrical tube arranged concentrically within the cylindrical housing, the adsorbent material being provided in an annular space defined between the bypass tube and the housing.

10. A device as claimed in claim 1, further comprising a pressure sensor mounted on the housing for determining the pressure within the chamber.

* * * * *